US006164349A

United States Patent [19]

Hsieh

[11] Patent Number: 6,164,349

[45] Date of Patent: Dec. 26, 2000

[54] MACHINE FOR CUTTING PLATES FROM TIMBER

[76] Inventor: Richard Hsieh, No. 16, Ru San Lane, Nan Yang Road, Fong Yuan City, Taichung Hsien, Taiwan

[21] Appl. No.: 09/376,387

[22] Filed: Aug. 18, 1999

[51] Int. Cl.[7] ..... B27M 1/08; B27C 9/00

[52] U.S. Cl. ..... 144/3.1; 37/41; 37/218; 37/237; 37/240; 37/367; 37/369; 144/375

[58] Field of Search ..... 144/3.1, 37, 39, 144/41, 363, 373, 374, 375, 369, 218, 237, 240, 367; 83/404, 425.2, 425.3, 51

[56] References Cited

U.S. PATENT DOCUMENTS

| | | | |
|---|---|---|---|
| 164,739 | 6/1875 | Holloway | 144/41 |
| 787,203 | 4/1905 | Mayhew | 144/39 |
| 987,012 | 3/1911 | Perkins | 144/37 |
| 2,055,401 | 9/1936 | Carlson | 144/41 |
| 2,449,605 | 9/1948 | Kelton | 144/37 X |
| 4,009,741 | 3/1977 | Zimmerman | 144/37 |
| 4,561,477 | 12/1985 | Zimmerman | 144/39 |
| 5,396,938 | 3/1995 | Cannaday | 144/39 |

*Primary Examiner*—W. Donald Bray
*Attorney, Agent, or Firm*—Charles E. Baxley

[57] ABSTRACT

A machine includes a number of saw blades rotatably supported on a spindle for cutting a timber into a number of panels. One or more feeder rollers may feed the timber through the saw blades. A number of cutter elements are disposed between the saw blades for forming a gap between the saw blades and for machining a rounded edge to each of the panels. A milling cutter is rotatably supported in front of the saw blades and includes one or more milling blades for machining the timber to form a number of rounded bulges before the timber is cut into the panels by the saw blades.

8 Claims, 5 Drawing Sheets

MACHINE FOR CUTTING PLATES FROM TIMBER

BACKGROUND OF THE INVENTION

1. Field of the Invention

The present invention relates to a machine, and more particularly to a machine for cutting a number of wood plates from a timber simultaneously.

2. Description of the Prior Art

Typical wood plates may be cut from a timber one at a time by a cutting machine and should be further treated or machined after being cut by the machine.

The present invention has arisen to mitigate and/or obviate the afore-described disadvantages of the conventional wood cutting machines.

SUMMARY OF THE INVENTION

The primary objective of the present invention is to provide a machine for forming a number of wood plates from a timber simultaneously without any further treatment or machining operations.

In accordance with one aspect of the invention, there is provided a machine comprising a body including a table for supporting a timber to be cut into a number of plates, a plurality of saw blades rotatably supported in the body on a spindle for cutting the timber into a number of panels and for forming a number of gaps between the panels, means for feeding the timber through the saw blades, and a plurality of cutter elements disposed between the saw blades for forming a gap between every two adjacent saw blades, the cutter elements each including a cutter edge for machining the panels to form a rounded edge.

A milling cutter is further rotatably supported in the body and includes at least one milling blade having a plurality of depressions defined between a plurality of cutter edges for machining the timber to form a number of rounded bulges before the timber is cut by the saw blades.

A spacing device is further provided for spacing the panels and includes a spacer having a plurality of fins extended therefrom and engaged inward of the gaps between the panels.

A positioning device is further provided for positioning the panels and includes a positioner wheel rotatably secured to the body and having a plurality of annular recess formed therein for receiving and for positioning the panels.

A cover is further provided in the body and includes a presser for resiliently positioning the timber. A presser member is further provided above the saw blades for positioning the timber. One or more feeder rollers of rubber or plastic materials are further provided for engaging with the panels.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figures 1, 2:
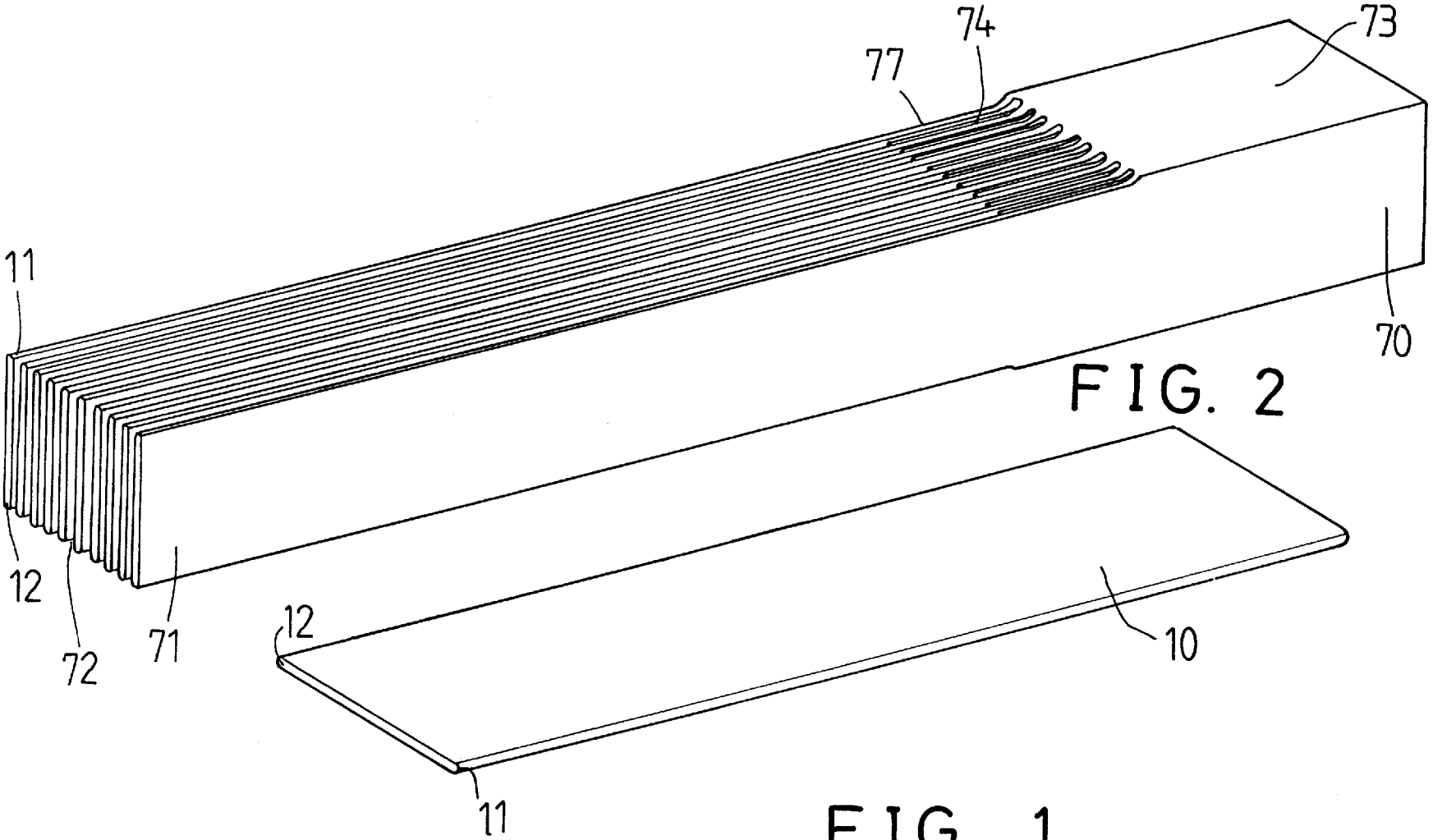
FIG. 1 is a perspective view of plate to be manufactured by a machine in accordance with the present invention.
FIG. 2 is a perspective view of the timber for forming the plates while being cut by the machine.

Referring to the drawings, and initially to FIGS. 1 and 2, a machine in accordance with the present invention is provided for cutting and forming a number of plates, particularly wood plates 10 (FIG. 1) from a wood block or a timber 70 (FIG. 2) simultaneously without any further treatment or machining operations. The plates 10 include the upper and/or the lower edges 11, 12 (FIGS. 1 and 2) that may be rounded simultaneously by the machine without any further machining operations.

Figure 3:
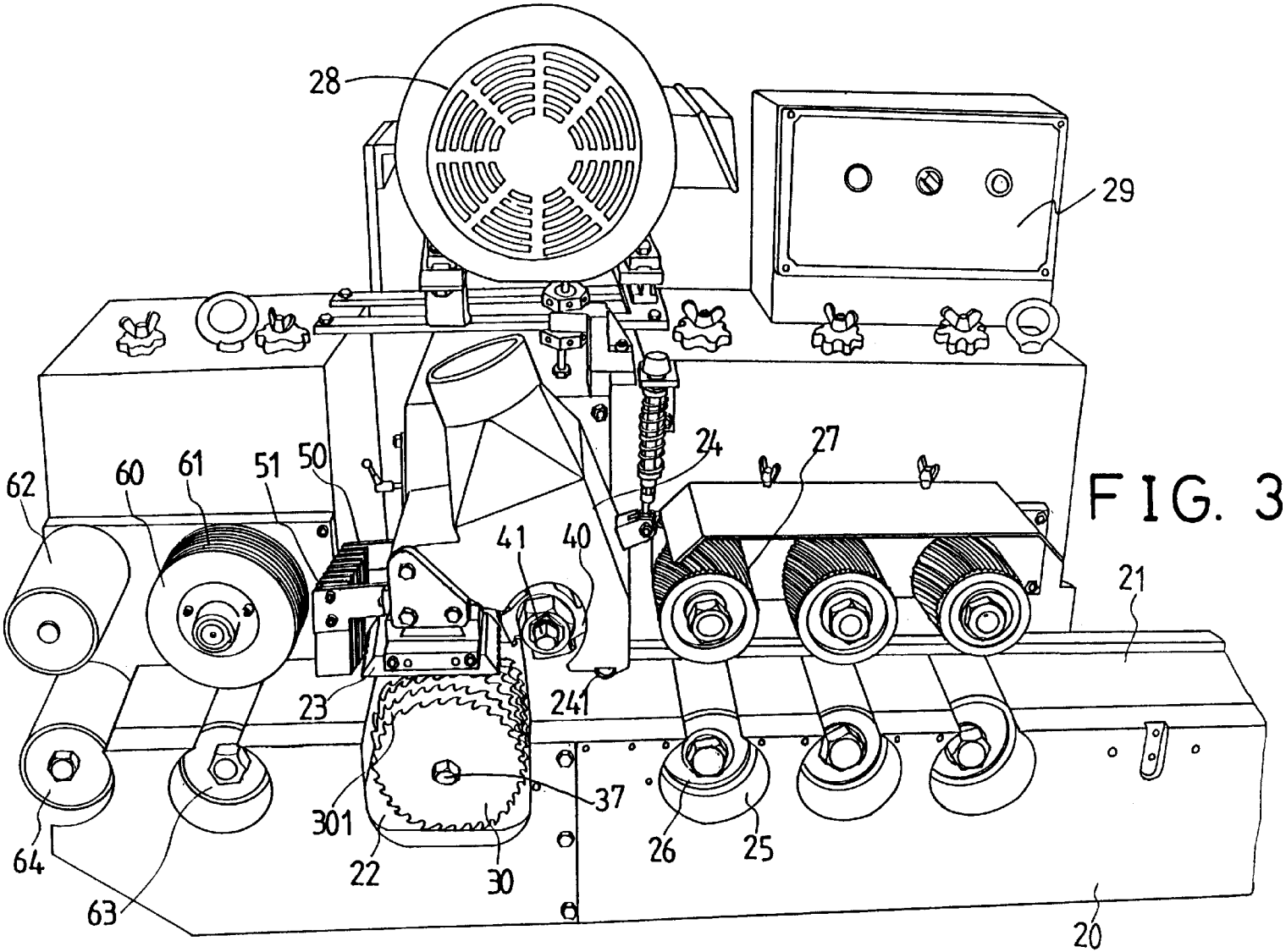
FIG. 3 is a perspective view of the machine in accordance with the present invention.
Figure 4:
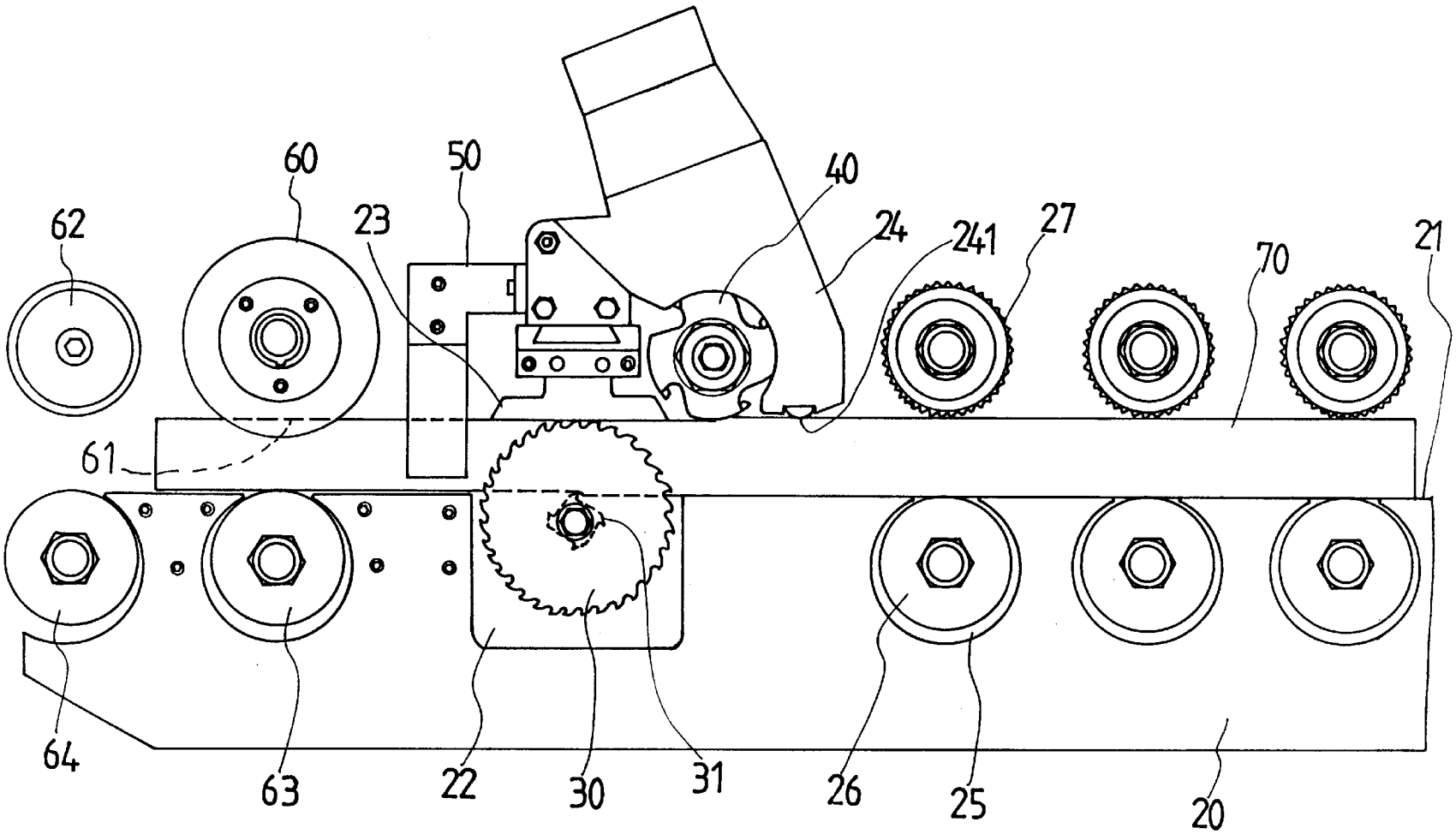
FIG. 4 is a front view of the machine.
Figure 5:
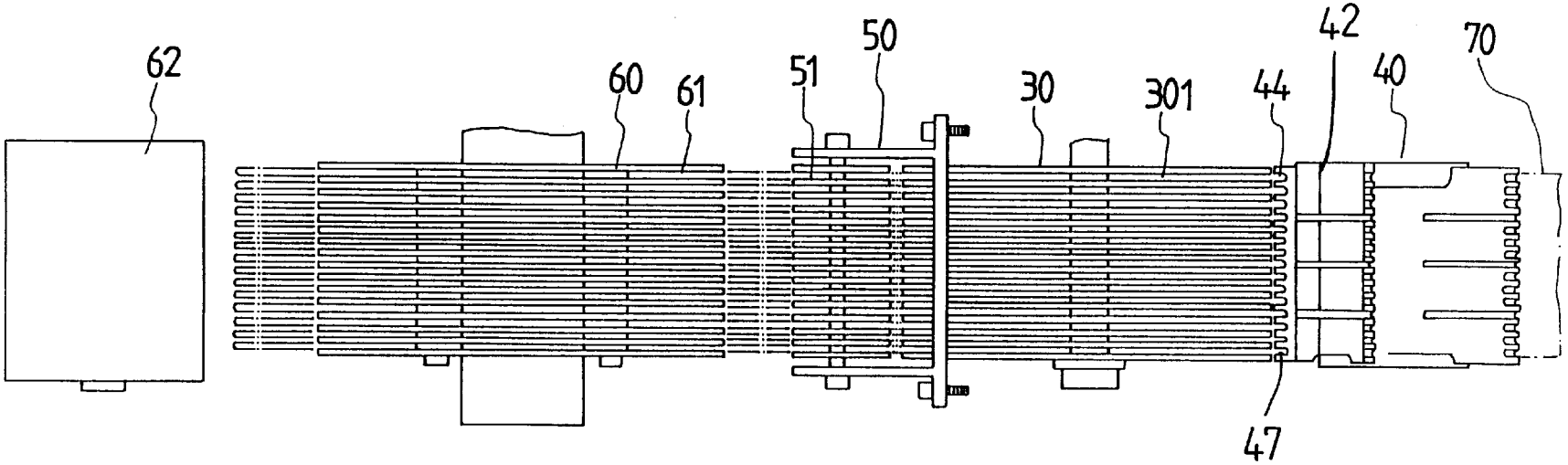
FIG. 5 is a top schematic view of the machine and the timber cut the machine.
Figure 6:
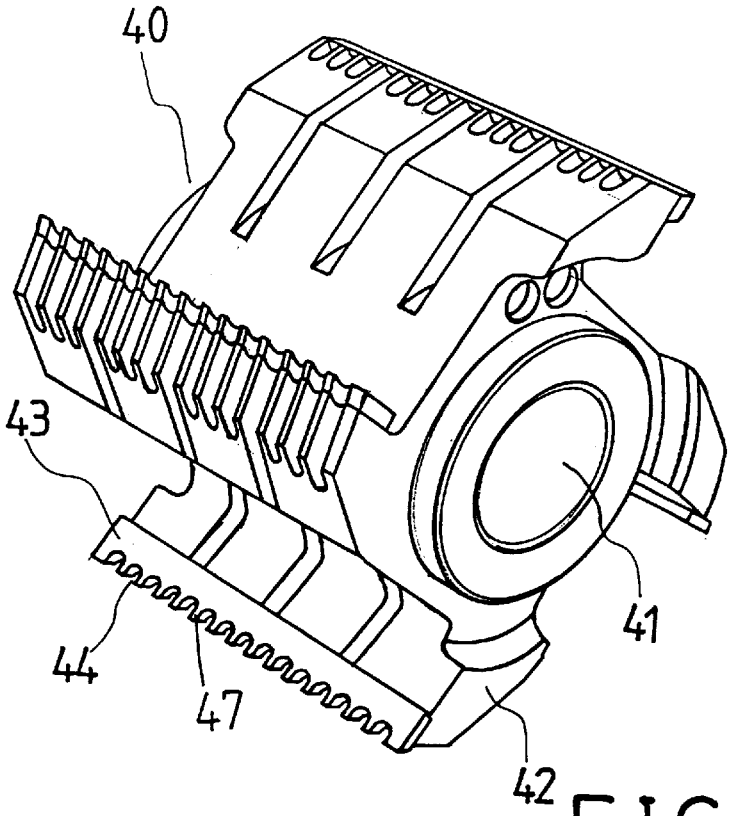
FIG. 6 is a perspective view of a milling cutter.

Referring next to FIGS. 3 and 4, the machine comprises a body 20 including a table 21 for supporting the wood blocks or the timbers to be machined by the machine. One or more pairs of feeder rollers 26, 27 are provided for engaging with and for feeding the timbers 70 forward or leftward through the working stations of the machine. The rollers 26 may be received in the orifices 25 of the body 20. A milling cutter 40 (FIG. 6) is rotatably supported above the table 21 on a pivot shaft 41 and is covered and shielded by a cover 24. The cover 24 preferably includes a resilient presser 241 provided in the bottom portion thereof for pressing the timbers 70 (FIG. 4) and for allowing the timbers 70 to be smoothly fed through the working stations of the machine. As shown in FIGS. 5 and 6, the milling cutter 40 includes one or more extensions 42 each having a milling blade 43 secured thereto by such as fasteners or by welding processes. The milling blades 43 each includes a number of depressions 44 formed between the cutter edges 47 for forming a number of rounded bulges 77 between grooves 74 (FIG. 2) on the timber 70.

Figure 7:
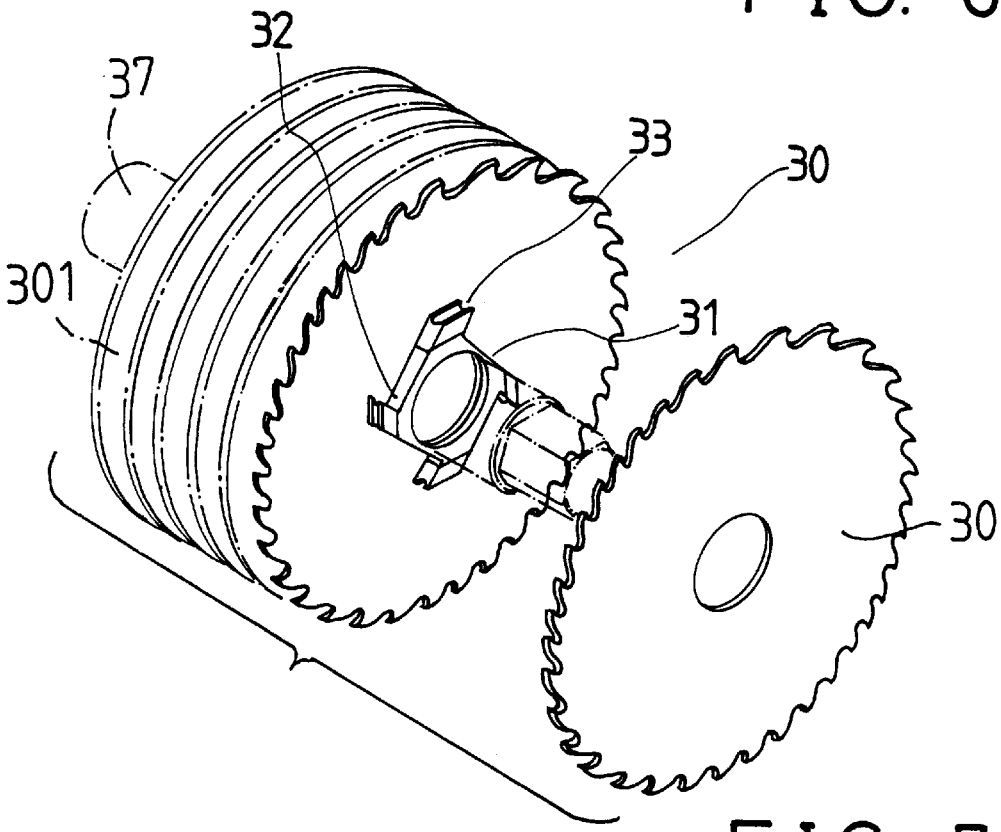
FIG. 7 is a partial exploded view of a groups of saw blades for cutting the timber.

Referring next to FIG. 7, and again to FIGS. 3–5, a number of saw blades 30 are rotatably secured in the body 20 on a spindle 37 and preferably rotatably received in a chamber 22 of the body 20. A number of cutting elements 31 are secured between the saw blades 30 for forming a gap 301 between every two adjacent saw blades 30 and each includes an extension 32 having a cutter edge 33 provided thereon for forming the rounded edges 12 of the plates 10. A presser member 23 is further provided above the saw blades 30 for pressing the timber 70 and for allowing the timber 70 to be stably fed through the saw blades 30. As shown in FIG. 2, a number of gaps 72 may be formed between a number of panels 71 by the saw blades 30 and are aligned with the grooves 74 of the timber 70. The rounded bulges 77 will then become the rounded edges 11 of the panels 71 and of the plates 10 later. The timber 70 may include a portion 73 that has not been cut yet and that may couple the panels 71 together. Accordingly, the rounded edges 11 of the plates 10 may be formed by the milling cutter 40 and the rounded edges 12 of the plates 10 may be formed by the cutting elements 31 when the plates 10 are formed.

Referring again to FIGS. 3–5, after the panels 71 are formed, the machine further provides a spacer 50 including a number of fins 51 extended inward of the gaps 72 between the panels 71 before the timber 70 is completely cut and before the panels 71 are separated from each other, for spacing and positioning the panels 71 and for preventing the panels 71 from oscillating or shaking. The machine may further provide a positioner wheel 60 having a number of annular recess 61 formed therein or having a number of gaps formed between a number of discs for receiving and for positioning the edges 11 of the panels 71. The machine may further provide a number of feeder rollers 62, 63, 64 of rubber or plastic materials for engaging with and for stably moving the panels 71 leftward before the panels 71 are separated to form the plates 10.

It is to be noted that the saw blades 30 and the milling cutter 40 may also be arranged or supported horizontally or inclined relative to a horizontal plane for cutting the timbers 70 laterally. A motor 28 is provided and coupled to the spindle 37 and/or the pivot shaft 41 and/or the feeder rollers 26, 27 for driving the same. A processing unit or a control device 29 may further be provided and coupled to the motor 28 for operating the machine.

Accordingly, the machine in accordance with the present invention may be used for forming a number of wood plates from a timber simultaneously without any further treatment or machining operations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A machine comprising:

a body including a table for supporting a timber to be cut into a number of plates, a plurality of saw blades rotatably supported in said body on a spindle for cutting the timber into a number of panels and for forming a number of gaps between the panels, means for feeding the timber through said saw blades, a plurality of cutter elements disposed between said saw blades for forming a gap between every two adjacent saw blades, said cutter elements each including a cutter edge for machining the panels to form a rounded edge, and a milling cutter rotatably supported in said body and including at least one milling blade having a plurality of depressions defined between a plurality of cutter edges for machining the timber to form a number of rounded bulges before the timber is cut by said saw blades.

2. A machine comprising:

a body including a table for supporting a timber to be cut into a number of plates, a plurality of saw blades rotatably supported in said body on a spindle for cutting the timber into a number of panels and for forming a number of gaps between the panels, means for feeding the timber through said saw blades, and a plurality of cutter elements disposed between said saw blades for forming a gap between every two adjacent saw blades, said cutter elements each including a cutter edge for machining the panels to form a rounded edge, and means for spacing the panels.

3. The machine according to claim 2, wherein said spacing means includes a spacer having a plurality of fins extended therefrom and engaged inward of the gaps between the panels.

4. The machine according to claim 1 further comprising means for positioning the panels.

5. The machine according to claim 4, wherein said positioning means includes a positioner wheel rotatably secured to said body and having a plurality of annular recess formed therein for receiving and for positioning the panels.

6. The machine according to claim 1 further comprising a cover provided in said body and including a presser provided thereon for engaging with and for positioning the timber.

7. A machine comprising:

a body including a table for supporting a timber to be cut into a number of plates, a plurality of saw blades rotatably supported in said body on a spindle for cutting the timber into a number of panels and for forming a number of gaps between the panels, means for feeding the timber through said saw blades, and a plurality of cutter elements disposed between said saw blades for forming a gap between every two adjacent saw blades, said cutter elements each including a cutter edge for machining the panels to form a rounded edge, and a presser member provided in said body and provided above said saw blades for engaging with and for positioning the timber.

8. The machine according to claim 1 further comprising at least one feeder roller provided in said body for engaging with the panels.

* * * * *